US012791294B2

(12) United States Patent
Sadler et al.

(10) Patent No.: US 12,791,294 B2
(45) Date of Patent: Nov. 10, 2026

(54) MULTI-DETONATOR EXPLOSIVE CHARGE

(71) Applicant: Raytheon Company, Arlington, VA (US)

(72) Inventors: Coulton T. Sadler, Tucson, AZ (US); Brian J. Lukow, Tucson, AZ (US); Christopher M. Turner, Oro Valley, AZ (US); Timothy R. Gast, Vail, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 19/176,737

(22) Filed: Apr. 11, 2025

(65) Prior Publication Data

US 2026/0318655 A1 Oct. 15, 2026

(51) Int. Cl.

| | |
|---|---|
| ***F42B 12/20*** | (2006.01) |
| ***F42B 12/22*** | (2006.01) |
| ***F42C 19/08*** | (2006.01) |
| ***F42C 19/095*** | (2006.01) |

(52) U.S. Cl.

CPC ..... *F42B 12/207* (2013.01); *F42C 19/0838* (2013.01); *F42C 19/0842* (2013.01); *F42C 19/0846* (2013.01); *F42C 19/095* (2013.01); *F42B 12/22* (2013.01)

(58) Field of Classification Search

CPC ..... F42B 12/00; F42B 12/02; F42B 12/207; F42B 12/208; F42B 12/20; F42B 12/22; F42C 19/095; F42C 19/0838; F42C 19/0842; F42C 19/0846

See application file for complete search history.

(56) References Cited

U.S. PATENT DOCUMENTS

| | | | | |
|---|---|---|---|---|
| 8,256,350 | B2 * | 9/2012 | Haskins | F42B 12/207 102/478 |
| 12,332,033 | B2 * | 6/2025 | Sadler | F42B 12/16 |
| 12,535,304 | B2 * | 1/2026 | Sadler | F42B 1/028 |
| 12,566,052 | B2 * | 3/2026 | Sadler | F42B 12/10 |
| 2024/0210147 | A1 * | 6/2024 | Cohen | F42B 12/208 |

* cited by examiner

*Primary Examiner* — James S Bergin

(74) *Attorney, Agent, or Firm* — Schwegman Lundberg & Woessner, P.A.

(57) ABSTRACT

A multi-detonator explosive charge/warhead eliminates the single point insensitive munitions failure of the detonator and can eliminate the single point insensitive munitions failure of the booster by eliminating the booster itself. The initiation of multiple detonators is timed such that the respective pressure waves constructively interfere to produce sufficient peak pressure to detonate the booster charge (if used) or to directly detonate the main explosive charge (whether a standard or insensitive main explosive charge). Detonation of any individual detonator or a subset of detonators within a narrow time window is insufficient to produce peak pressures capable of detonation the booster charge or main explosive charge, thus eliminating the single point failure associated with the single detonator and possibly the booster charge.

18 Claims, 8 Drawing Sheets

MULTI-DETONATOR EXPLOSIVE CHARGE

BACKGROUND

Field

This disclosure relates to explosive charges and warheads that must satisfy Insensitive Munitions (IM) requirements.

Description of the Related Art

Warheads are typically classified as blast, fragmentation or shaping. A blast warhead relies on the over pressure created by detonation of the explosive charge. A fragmentation warhead uses the detonation of the explosive charge to project metal fragments outward from the warhead. A shaping warhead uses the detonation of the explosive charge to symmetrically collapse a conically-shaped metal liner to project an on-axis penetrator, which can be a shaped-charge jet (SCJ) or an explosively formed penetrator (EFP).

As shown in FIGS. 1A and 1B, a fragmentation warhead 100 includes a main explosive charge 102 inside a metal casing 104. Standard explosive charges include PBXN-9, LX-14, PBXN-110, PBXN-109 or PBXN-112, which have a detonation threshold between 2 and 5 GPa, are designed to mazimize output energy. An insensitive explosive charge such as TATB requires a higher peak pressure, at least 10 GPa, to detonate but produces less output energy. A booster explosive 106 is positioned on-axis inside an aft portion of main explosive charge 102. Typical booster explosives are PBXN-5, CH-6 or Composition A5. A single detonator 108 is coupled to booster explosive 106. Detonator 108 is responsive to an electric stimulus to fire and produce a pressure wave having sufficient peak pressure to detonate booster explosive 106, which in turn produces a pressure wave having sufficient peak pressure to detonate main explosive charge 102.

Many military grade munitions such as bombs and missiles, qualified to Insensitive Munitions (IMs) requirements. IMs are designed to withstand stimuli representative of severe but credible accidents. The range of stimuli include shock, heat and adjacent detonation munitions. Military grade munitions must also be highly reliable. The main charge must detonate when commanded. The testing for both reliability and IM compliance is very rigorous to demonstrate the safety of the explosive charge or warhead in the field. Shock testing typically involves impact due to a bullet or fragment or detonation of adjacent munitions. Heat testing includes both fast and slow cookoff. Fast cookoff simulates a missile and warhead hanging on the wing of an aircraft when a fuel fire ignites below the missile. The temperature can increase by 800° C. in 1-2 minutes. Slow cookoff simulates either storage at very high temperatures or a fire in an adjacent storage bay. The temperature increases approximately 15° C./hr. The warhead must be able to withstand these tests without detonation.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides a multi-detonator explosive charge configuration that eliminates the single point IM failure of the detonator and can eliminate the single point IM failure of the booster by eliminating the booster itself. The initiation of multiple detonators is timed such that the respective pressure waves constructively interfere to produce sufficient peak pressure to detonate the booster (if used) or to directly detonate the main explosive charge (whether a standard or insensitive explosive charge). Detonation of any individual detonator or a subset of detonators within a narrow time window is insufficient to produce peak pressures capable of detonating the booster or main explosive charge, thus eliminating the single point failure associated with the single detonator. By constructively interfering the pressure waves of multiple detonators, the peak pressure can be sufficient to directly detonate the main explosive charge, whether a standard or insensitive explosive charge, sans the booster explosive, thus eliminating the single point failure.

In an embodiment, an explosive charge includes a main explosive charge and N detonators wherein N is an integer of two or more coupled to the main explosive charge. The detonators may be coupled to the main explosive charge through a booster explosive or may be directly coupled to the main explosive. The timed initiation of at least M detonators where M is an integer <=N produces pressure waves that constructively interfere to produce sufficient peak pressure at an initiation point to detonate the main explosive charge. The initiation of any one of the N detonators produces a peak pressure insufficient to detonate the main explosive charge thereby eliminating a single point failure.

In an embodiment, initiation of all N detonators is required to produce sufficient peak pressure at the initiation point. In another embodiment, initiation of M<N detonators is sufficient to produce the required peak pressure at the initiation point.

In an embodiment, the detonators are configured such that they are initiated simultaneously, within a narrow time window of no more than 10 microseconds, suitably less than 5 microseconds, and most preferably within 2 microseconds, such that the pressure waves constructively interfere at the initiation points.

In an embodiment, the detonators are configured such that one or more detonators must be delayed (outside the narrow time window) such that the pressure waves constructively interfere at the initiation points. In one case, the detonators are configured with different spacings to the main explosive charge. In another case, the detonators are configured with different spacings to each other.

In an embodiment, the initiation of <M detonators within the narrow time window produces a peak pressure at the initiation point that is insufficient to detonate the explosive charge. Furthermore, the probability that M detonators will spontaneously initiate within the narrow time window due to a shock test or slow or fast-cook off test for Insensitive Munitions (IM) is less than a defined allowable risk. The allowable risk may, for example, be 1%.

In an embodiment, the main explosive charge is a standard explosive charge selected from PBXN-9, LX-14, PBXN-110, PBXN-109 or PBXN-112. Standard explosive charges are configured to maximize output energy upon detonation and exhibit detonation thresholds of between 2 and 5 GPa, typically closer to 2 GPa.

In an embodiment, the main explosive charge is an insensitive explosive charge such as TATB or IMX-101. Insensitive explosive charges produce lower output energies but exhibit a detonation threshold of at least 10 Gpa.

In an embodiment, the main explosive charge is configured as a blast or fragmentation warhead. The N detonators are configured to optimize the output energy produced by detonation of the main explosive charge.

In an embodiment, the main explosive charge is configured as a forming charge in which the main explosive charge is compressed to form a cone whose apex lies along an axis and a conically-shaped metal liner is placed in direct contact with the surface of the main explosive charge. The N detonators are positioned off-axis such that their pressure waves constructively interfere at the single initiation point with a peak pressure to detonate the main explosive charge and project a penetrator. In one case, the detonation of the plurality of off-axis detonators produces a detonation wave that symmetrically collapses the conically-shaped liner to form and project an on-axis penetrator. In another case, detonation of the plurality of off-axis detonators produces a detonation wave that asymmetrically collapses the conically-shaped liner to form and project an off-axis penetrator.

These and other features and advantages of the disclosure will be apparent to those skilled in the art from the following detailed description of preferred embodiments, taken together with the accompanying drawings, in which:

DETAILED DESCRIPTION

The current explosive charge configuration has two possible "single point failures" in the detonator and the booster explosive for IM requirements. Should either detonate under IM testing or real-world conditions, the explosive charge will detonate.

The present disclosure provides a multi-detonator explosive charge/warhead configuration that eliminates the single point failure of the detonator and can eliminate the single point failure of the booster by eliminating the booster itself. The initiation of multiple detonators is timed such that the respective pressure waves constructively interfere to produce sufficient peak pressure to detonate the booster (if used) or to directly detonate the main explosive charge (whether a standard or insensitive explosive charge). Detonation of any individual detonator or a subset of detonators within a narrow time window is insufficient to produce peak pressures capable of detonation the booster or explosive charge, thus eliminating the single point failure associated with the single detonator. By constructively interfering the pressure waves of multiple detonators, the peak pressure can be sufficient to directly detonate the main explosive charge, whether a standard or insensitive explosive charge, sans the booster explosive, thus eliminating another single point failure.

Any single detonator that initiates is insufficient to produce a peak pressure to detonate the main charge. In fact, the initiation of <M detonators within the narrow time window produces a peak pressure at the initiation point that is insufficient to detonate the explosive charge. Furthermore, the probability that M detonators will spontaneously initiate within the narrow time window due to a shock test or slow or fast-cook off test for Insensitive Munitions (IM) is less than a defined allowable risk. The allowable risk may, for example, be 1%. M may be as small as two but is typically three or more.

A second single point failure can be eliminated by removing the booster explosive and having the detonators directly coupled to the main explosive charge. The constructive interference of the at least M detonators provides a peak pressure at the initiation point greater than the detonation TH of the main explosive charge whether that charge is a standard explosive charge or an insensitive explosive charge.

Figure 1A:
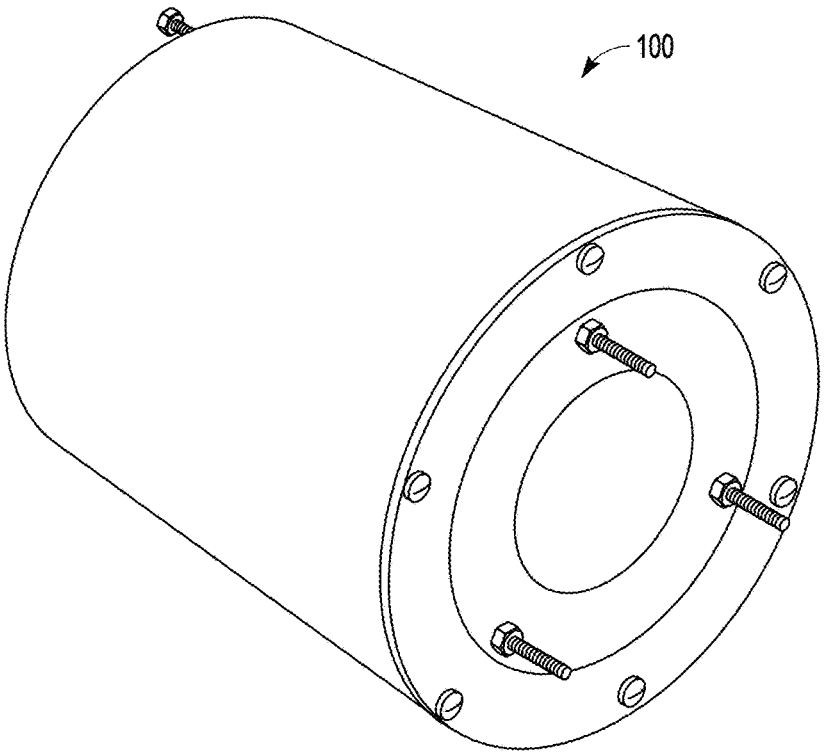
FIG. 1A (PRIOR ART)
FIGS. 1A-1B, as described above, illustrate a warhead in which the firing train includes a single on-axis detonator, a booster charge and a main charge.
Figure 1B:
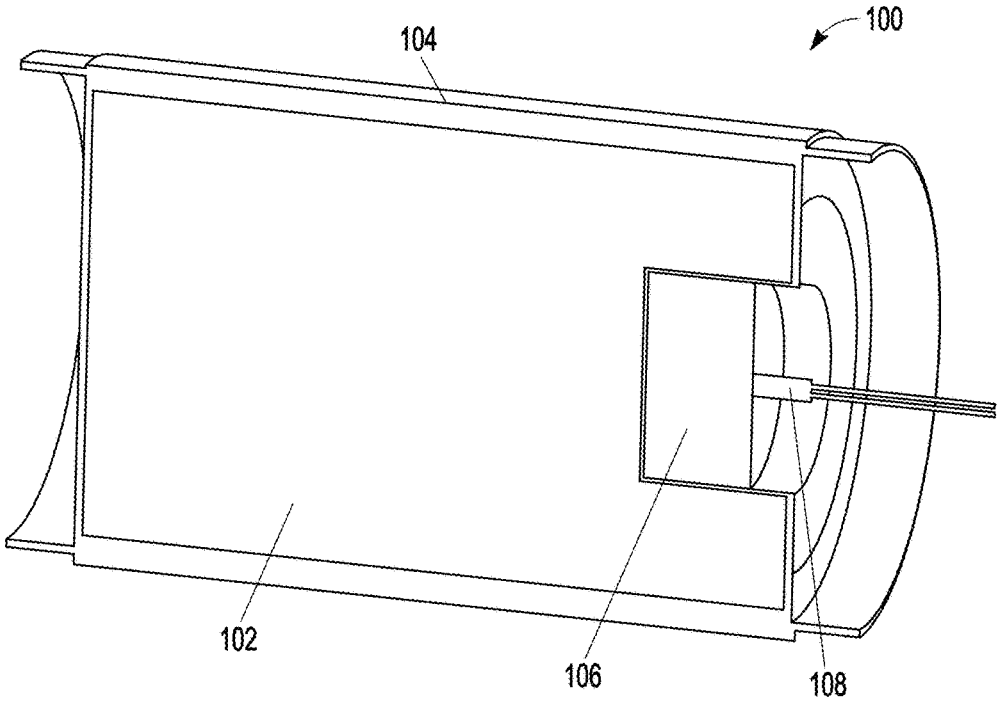
FIG. 1B (PRIOR ART)
Figure 2A:
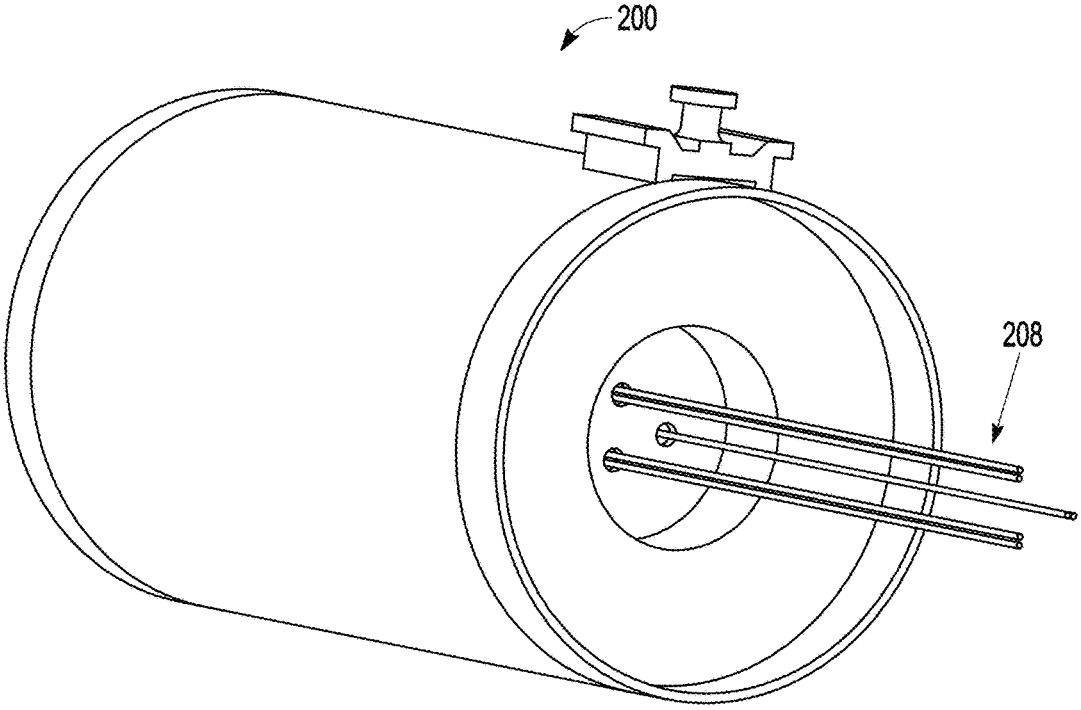
FIGS. 2A-2B illustrate a warhead in which the firing train includes a plurality of detonators directly coupled to a main charge.
Figure 2B:
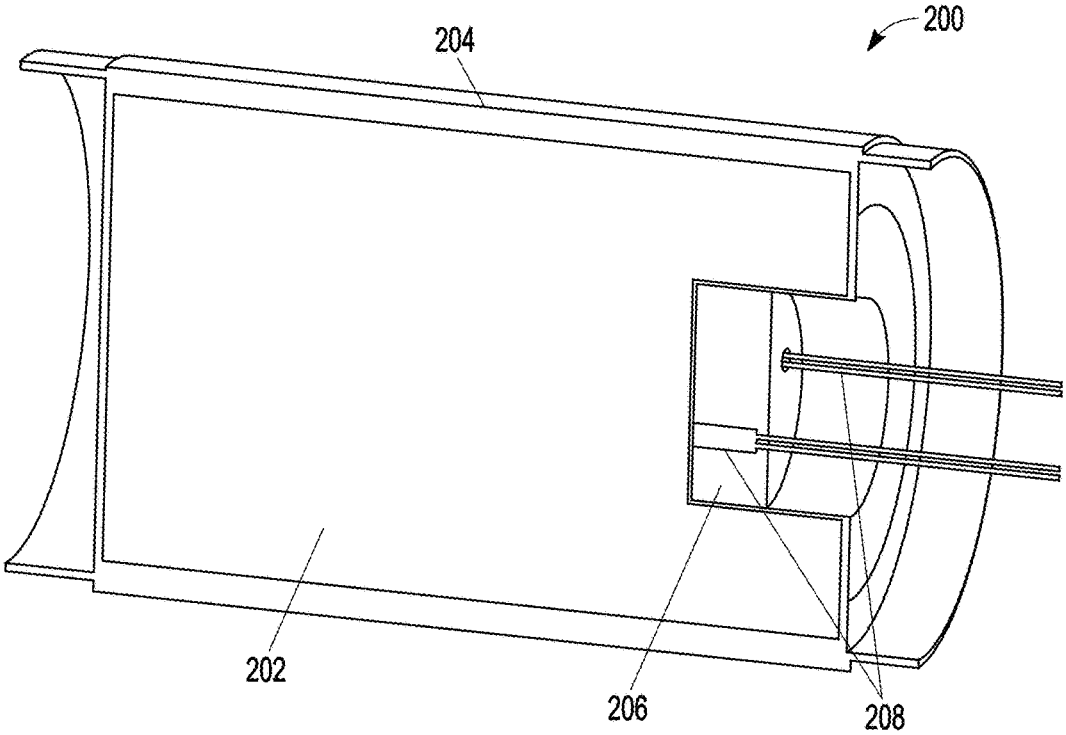
Figure 3:
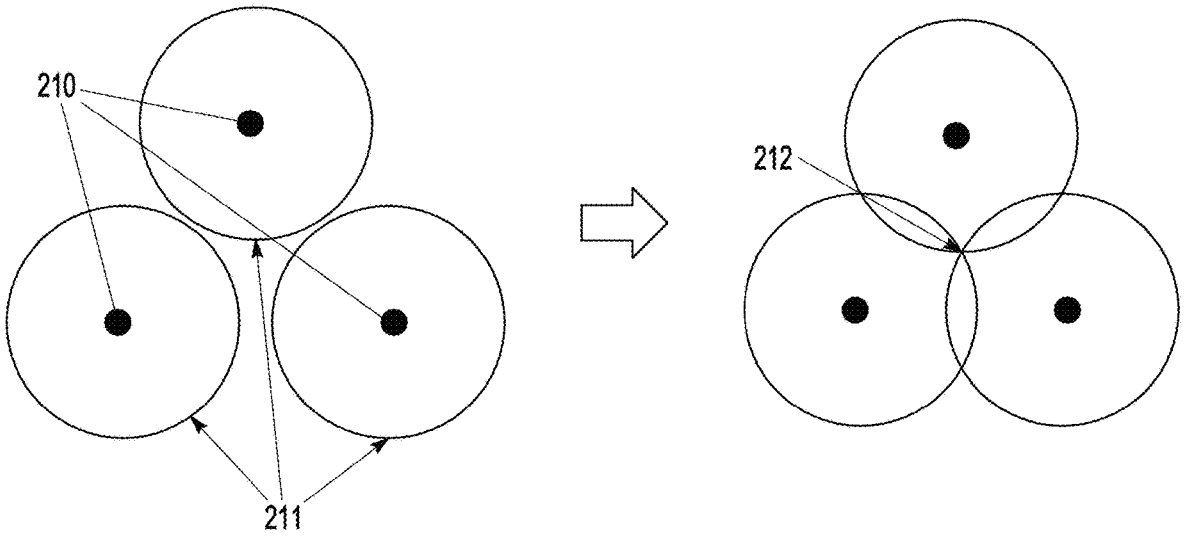
FIG. 3 illustrates N=3 detonators that are positioned and simultaneously initiated to constructively interfere at a single detonation point with sufficient pressure to detonate the main charge.

As shown in FIGS. 2A-2B and 3, a fragmentation warhead 200 includes a main explosive charge 202 inside a metal casing 204. Standard explosive charges include PBXN-9, LX-14, PBXN-110, PBXN-109 or PBXN-112, which have a detonation threshold of between 2 and 5 GPa are designed to mazimize output energy. An insensitive explosive charge such as TATB or IMX-101 requires a higher peak pressure, at least 10 GPa, to detonate but produces less output energy. A multi-detonator holder 206 is positioned on-axis inside an aft portion of main explosive charge 202. A plurality of detonators 208 (N where N is an integer of two or more) are coupled to muti-detonator holder 206. Each detonator 208 is responsive to an electric stimulus to fire and produce a pressure wave having insufficient peak pressure to detonate the main explosive charge 202. The timed initiation of at least M detonators where M is an integer <=N at detonation points 210 produces pressure waves 211 that constructively interfere to produce sufficient peak pressure at an initiation point 212 to detonate the main explosive charge 202.

Figure 4:
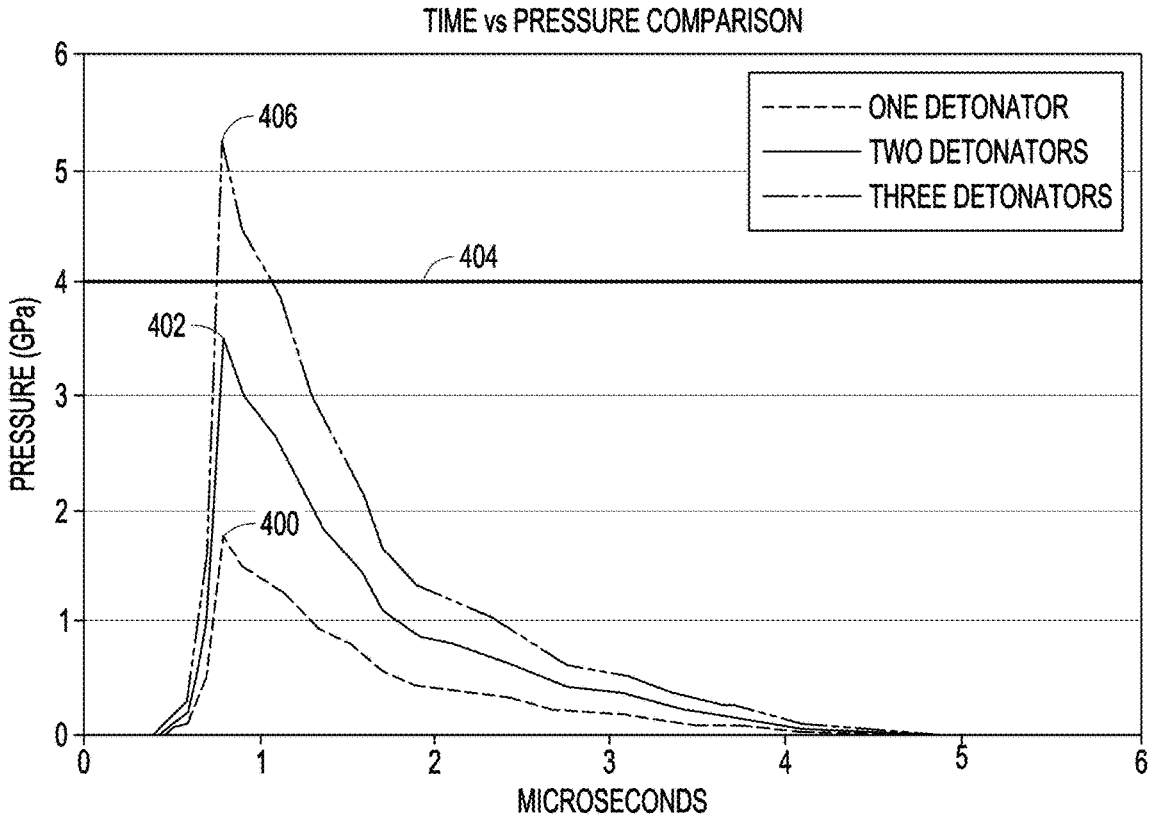
FIG. 4 is a plot that depicts the pressure levels for one, two and three detonators being simultaneously initiated in which only the three detonators provide sufficient pressure to detonate the main charge.

As shown in FIG. 3, the detonators 208 are configured such that simultaneous initiation, defined as initiation of the detonators within a narrow time window of no more than 10 microseconds, suitably less than 5 microseconds, and most preferably within 2 microseconds, is required such that the pressure waves constructively interfere at the initiation points. In this example, simultaneous initiation of all N=3 detonators is required to achieve the requisite peak pressure. As shown in FIG. 4, the peak pressures 400 and 402 achieved by initiating a single or pair of detonators falls below the pressure threshold 404 required to detonate the main explosive charge. Only the simultaneous detonation of all three detonators produces a peak pressure 406 that exceeds pressure threshold 404.

In an embodiment, the initiation of <M detonators (where M is an integer <=N) within the narrow time window produces a peak pressure at the initiation point that is insufficient to detonate the explosive charge. Furthermore, the probability that M detonators will spontaneously initiate within the narrow time window due to a shock test or slow or fast-cook off test for Insensitive Munitions (IM) is less than a defined allowable risk. The allowable risk may, for example, be 1%.

A booster explosive may positioned on-axis inside an aft portion of main explosive charge 202. Typical booster explosives are PBXN-5, CH-6 or Composition A5. In this configuration, the N detonators would be configured to constructively intefere to provide a peak pressure at an initiation point to detonator, which in turn detonates the main explosive charge. Although this configuration is feasible the booster explosive would remain as a single point failure.

Figure 5:
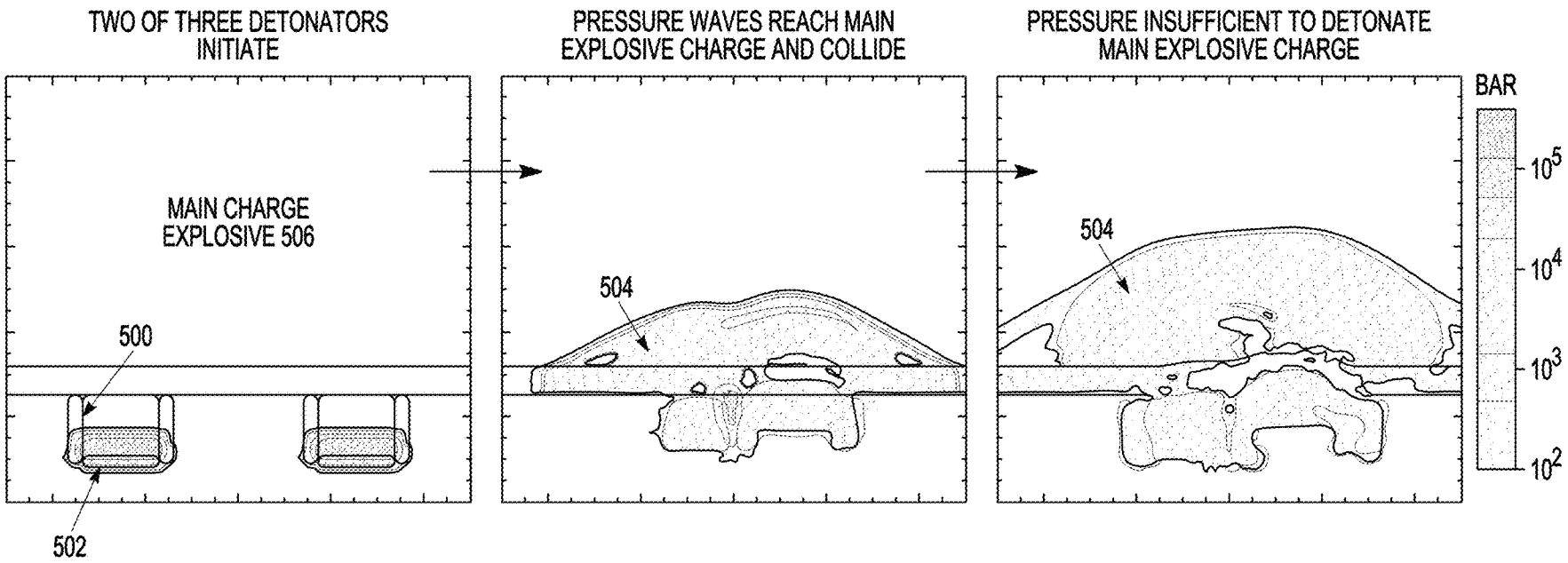
FIG. 5 illustrates a detonation sequence in which only two of the three detonators initiate generating insufficient pressure to detonate the main charge.

Referring now to FIG. 5, two of the three detonators 500 such as shown in FIGS. 2A-2B and 3 are simultaneosly initiated 502. Pressure waves 504 for the two detonatores reach a main explosive charge 506 and collide but the peak pressure is insufficient to detonate the main explosive charge.

Figure 6:
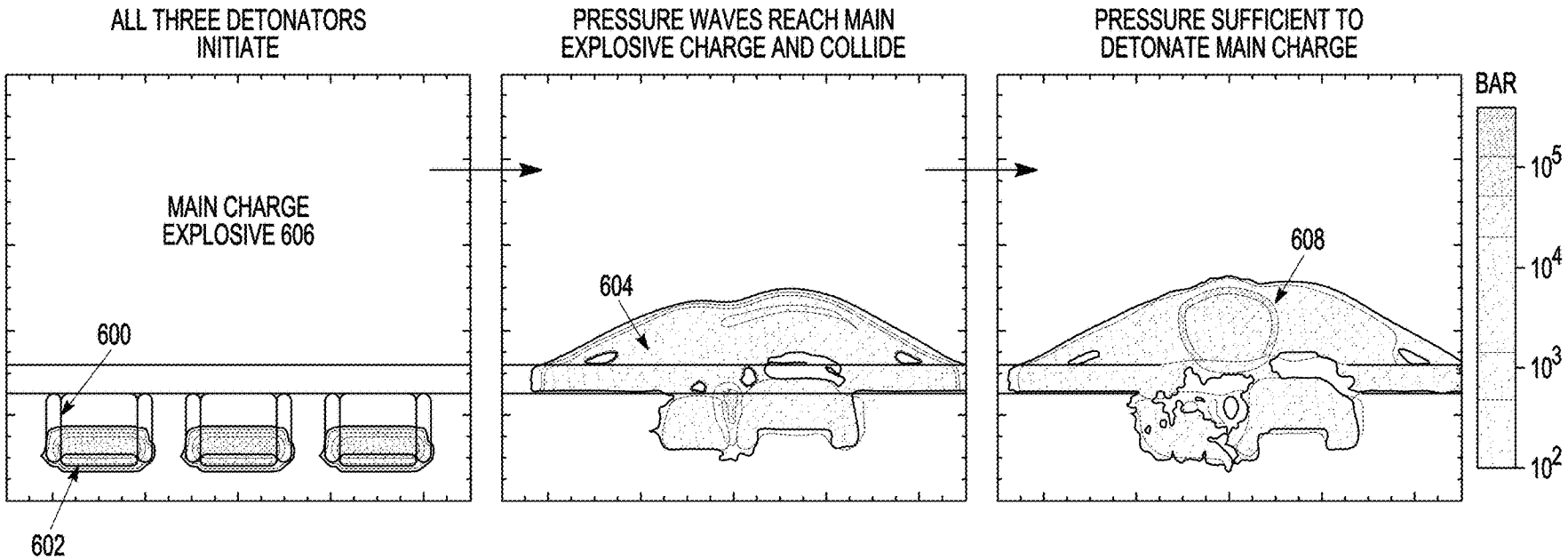
FIG. 6 illustrates a detonation sequence in which all three detonators initiate generating sufficient pressure to detonate the main charge.

Referring now to FIG. 6, all three of the detonators 600 such as shown in FIGS. 2A-2B and 3 are simultaneosly initiated 602. Pressure waves 604 for all three detonatores reach a main explosive charge 606 and collide producing a peak pressure sufficient to detonate the main explosive charge and produce a detonation wave 608.

Figure 7:
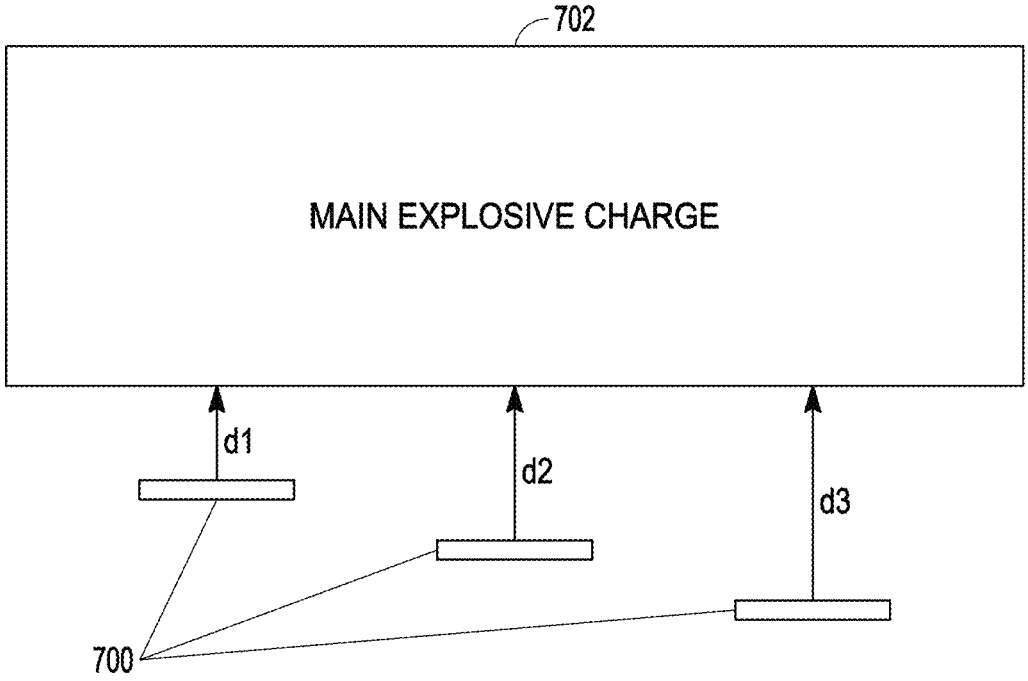
FIG. 7 illustrates an embodiment in which the detonators are positioned at different distances to the main charge and their initiation timed such that all the flyers hit the main charge simultaneously.
Figure 8:
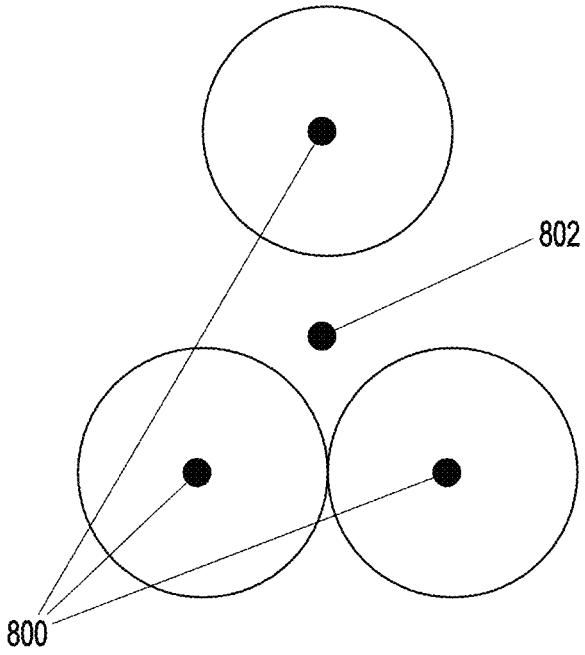
FIG. 8 illustrates an embodiment in which the detonators are positioned at the same distance to the main charge but different distances to each other and their initiation timed so that their detonation waves constructively interfere at the single detonation point.

In an embodiment, the detonators are configured such that one or more detonators must be delayed (outside the narrow time window) instead of all initiated simultaneously such that the pressure waves constructively interfere at the initiation points. As shown in FIG. 7, detonators 700 are configured with different spacings d1, d2 and d3 to a main explosive charge 702. The timing of the detonators 700 must be adjusted/delayed such that the flyer plates from all three detonators impact the main explosive charge simultaneously. As shown in FIG. 8, detonators 800 are configured with different spacings to each other. The timing of the detonators 800 must be adjusted/delayed so that the pressure waves constructively interfere at initiation point 802.

Figure 9:
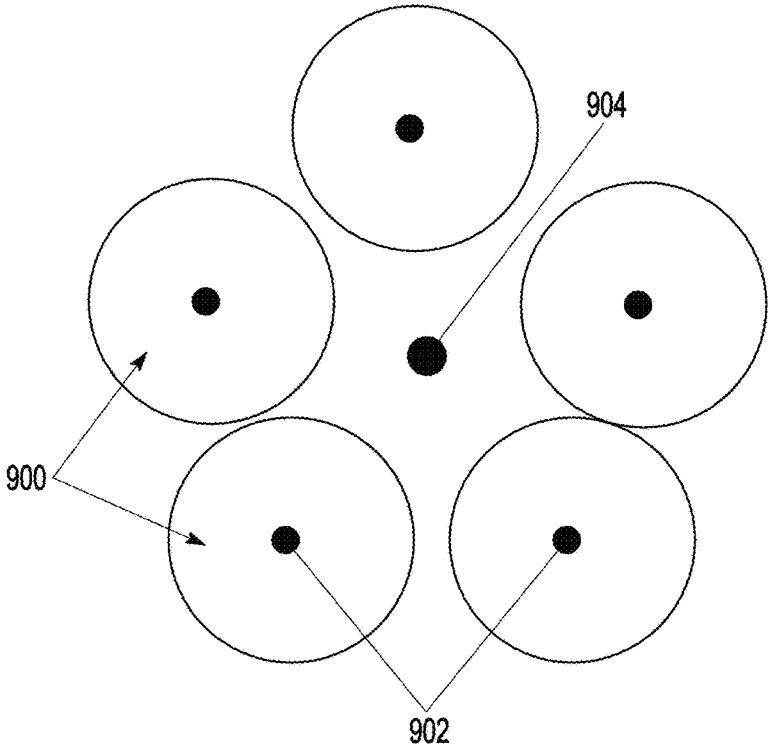
FIG. 9 illustrates an embodiment in which N=5 detonators are positioned and simultaneously initiated to constructively interfere at a single detonation point with only M=3 detonators required to produce sufficient pressure to detonate the main charge.

In another embodiment, the N detonators 900 are configured such that a subset of M<N detonators may be detonated and their pressure waves constructively interfered to produce a sufficient peak pressure to detonate the main explosive charge. As shown in FIG. 9, N=5 detonators are configured to initiate at detonation points 902 such that their pressure waves constructively interfere to produce a peak pressure at initiation point 904. In this case, N=3 detonators is sufficient to produce the requisite peak pressure.

Figure 10:
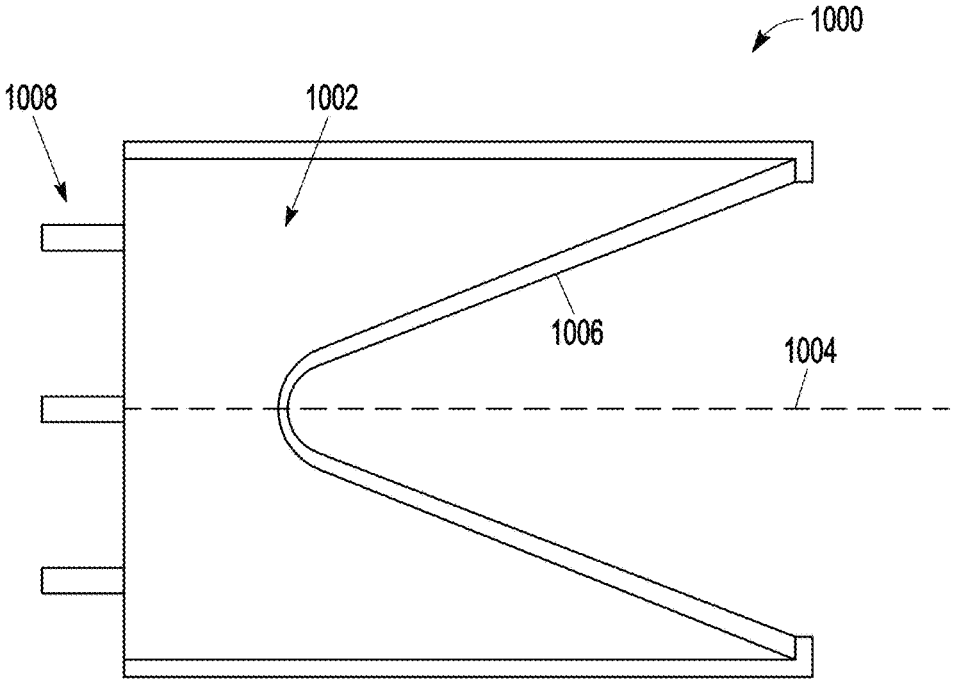
FIG. 10 illustrates an embodiment of a forming warhead in which multiple detonators are configured to both form the penetrator and to detonate the main explosive charge.

If the explosive charge is a forming warhead 1000 of the type shown in FIG. 10, a main explosive charge 1001 is compressed to form a cone whose apex 1002 lies along an axis 1004 and a conically-shaped metal liner 1006 is placed in direct contact with the surface of the main explosive charge. N detonators 1008 (where N=3 in this case) are positioned off-axis such that their pressure waves constructively interfere at a single initiation point with a peak pressure to detonate the main explosive charge 1000 and project a penetrator.

Figure 11B:
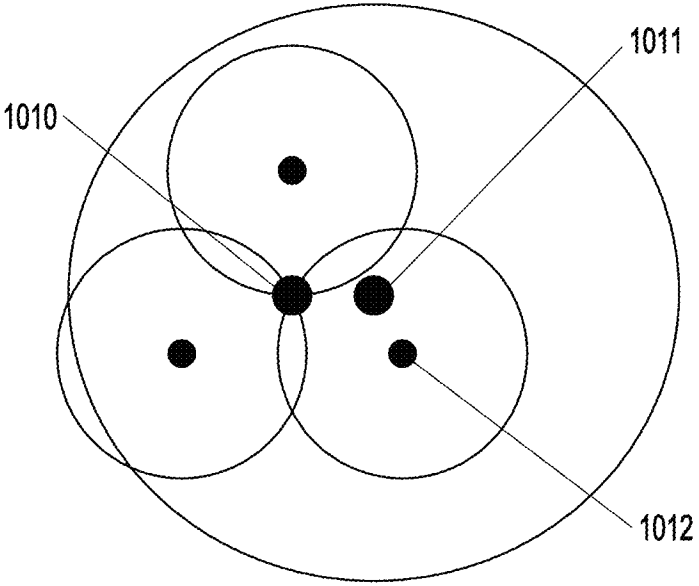
FIGS. 11A-11B illustrate a forming warhead in which the detonators are configured to form an on-axis and off-axis slashing penetrator, respectively.
Figure 11A:
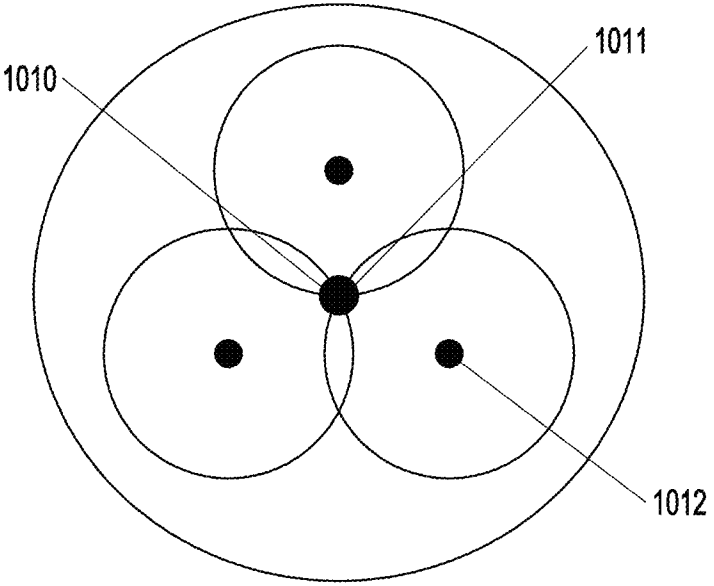

As shown in FIGS. 11A, if the single initiation point 1010 lies on axis 1011, the detonation of the plurality of off-axis detonators 1008 at detonation points 1012 produces a detonation wave that symmetrically collapses the conically-shaped liner 1006 to form and project an on-axis penetrator (SCJ or EFP). The on-axis penetrator has only an axial velocity and its mass is confined about the axis. The on-axis penetrator is optimized to penetrate deep into heavily armored targets.

As shown in FIGS. 11B, if the single initiation point 1010 lies off axis 1011, the detonation of the plurality of off-axis detonators 1008 at detonation points 1012 produces a detonation wave that symmetrically collapses the conically-shaped liner 1006 to form and project an on-axis slashing penetrator (SCJ or EFP). the off-axis slashing penetrator has both axial and radial velocity, the axial velocity increases with the distance from the axis such that the tip of the slashing penetrator reaches the target first and the mass decreases with the distance from the axis. The mass of the slashing penetrator is spread over a larger coverage or lethal area to prosecute the target. The off-axis slashing penetrator is formed opposite the position of the off-axis detonator and the length of the off-axis slashing penetrator increases as the displacement of the off-axis detonator from the axis increases.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. An explosive charge, comprising:

a main explosive charge, and

N detonators wherein N is an integer of two or more coupled to the main explosive charge, wherein timed initiation of at least M detonators where M is an integer of two or more and M<=N produces M pressure waves that constructively interfere to produce sufficient peak pressure at an initiation point to detonate the main explosive charge;

wherein initiation of less than M detonators produces a peak pressure insufficient to detonate the main explosive charge.

2. The explosive charge of claim 1, wherein M=N, wherein all N detonators are initiated simultaneously.

3. The explosive charge of claim 1, where M<N, wherein at least M detonators are initiated.

4. The explosive charge of claim 1, wherein the initiation of at least one detonator is delayed to produce a pressure wave that constructively interferes with the other pressure waves.

5. The explosive charge of claim 1, wherein a probability that M detonators will initiate simultaneously due to a slow or fast cook-off for Insensitive Munition (IM) is less than a defined allowable risk.

6. The explosive charge of claim 1, wherein the main explosive charge has a detonation threshold of at least 10 Gpa.

7. The explosive charge of claim 6, wherein the N detonators are coupled directly to the main explosive charge without an intervening booster charge.

8. The explosive charge of claim 1, wherein the N detonators are coupled directly to the main explosive charge without an intervening booster charge.

9. The explosive charge of claim 1, where the main explosive charge is configured as a blast or fragmentation warhead, wherein the N detonators are configured to optimize the output energy produced by detonation of the main explosive charge.

10. The explosive charge of claim 1, wherein the main explosive charge is configured as a forming charge in which the main explosive is compressed to form a cone whose apex lies along an axis and a conically-shaped metal liner is placed in direct contact with the surface of the main explosive charge, wherein the N detonators are positioned off-axis such that their pressure waves constructively interfere at a single initiation point with a peak pressure to detonate the main explosive charge and project a penetrator.

11. The forming warhead of claim 10, wherein the single initiation point lies on axis, wherein detonation of the plurality of off-axis detonators produces a detonation wave that symmetrically collapses the conically-shaped liner to form and project an on-axis penetrator.

12. The forming warhead of claim 10, wherein the single initiation point lies off-axis, wherein detonation of the plurality of off-axis detonators produces a detonation wave that asymmetrically collapses the conically-shaped liner to form and project an off-axis penetrator.

13. An explosive charge, comprising:

a main explosive charge, and a plurality of detonators coupled to the main explosive charge, wherein all of the plurality of detonators are initiated simultaneously to produce pressure waves that constructively interfere to produce sufficient peak pressure at an initiation point to detonate the main explosive charge;

wherein simultaneous initiation of less than all of the plurality of detonators produces a peak pressure insufficient to detonate the main explosive charge.

14. The explosive charge of claim 13, wherein a probability that all of the plurality of detonators will initiate simultaneously due to a slow or fast cook-off for Insensitive Munition (IM) is less than a defined allowable risk.

15. The explosive charge of claim 13, wherein the explosive charge does not have a booster charge.

16. An explosive charge, comprising:

a main explosive charge having a detonation threshold of at least 10 GPa, and

N detonators wherein N is an integer of two or more directly coupled to the main explosive charge without an intervening booster charge, wherein timed initiation of at least M detonators where M is an integer of two or more and M<=N produces M pressure waves that constructively interfere to produce sufficient peak pressure at an initiation point that exceeds 10 GPa to detonate the main explosive charge;

wherein initiation of less than M detonators produces a peak pressure less than 10 Gpa.

17. The explosive charge of claim 16, wherein a probability that M detonators will initiate simultaneously due to a slow or fast cook-off for Insensitive Munition (IM) is less than a defined allowable risk.

18. The explosive charge of claim 16, wherein M=N, wherein all N detonators are initiated simultaneously.

* * * * *